US005803456A

United States Patent [19]

Lam

[11] Patent Number: 5,803,456

[45] Date of Patent: Sep. 8, 1998

[54] GAME

[76] Inventor: Kam Yuet Lam, Flat E, 5th Floor, Tropicana Garden, Block A, 110 Lung Cheung Road, Wong Tai Sin, Kowloon, Hong Kong

[21] Appl. No.: 889,297

[22] Filed: Jul. 8, 1997

[51] Int. Cl.[6] ..... A63F 3/00

[52] U.S. Cl. ..... 273/256

[58] Field of Search ..... 273/242, 243, 273/248, 249, 256

[56] References Cited

U.S. PATENT DOCUMENTS

| | | | |
|---|---|---|---|
| 4,065,131 | 12/1977 | Martin, Jr. et al. | 273/243 |
| 4,279,422 | 7/1981 | Shaw | 273/256 |
| 4,445,692 | 5/1984 | Boyle | 273/256 |
| 4,840,382 | 6/1989 | Rubin | 273/256 X |
| 4,884,818 | 12/1989 | Fogarty | 273/256 |

*Primary Examiner*—William E. Stoll

*Attorney, Agent, or Firm*—Miller, Sisson, Chapman & Nash, P.C.

[57] ABSTRACT

A kit of parts for playing a game comprises a board with a first set of spaces to enable playing a game of the kind specified and relating to financial transactions and investments. The board also includes a second type of spaces spread in sequence around the board onto which second respective markers of each player may land in turn under the control of the throw of a dice. The second type of spaces provide various opportunities and liabilities dictated or influenced by "political" factors and events. The presence of "political" spaces add variations that may affect the financial decisions of the players. This makes the game more interesting and, as an educational element, introduces the players to the reality or possibility that "politics" normally influence day-to-day financial transactions.

6 Claims, 8 Drawing Sheets

FLOW CHART OF THE OVERALL GAME

REMARKS: PLAYERS A,B,C,D.
indicating corresponding chests of dollars and flags.
I.M. stands for investment marks
P.M. stands for political marks

LOGIC FLOW CHART FOR BUYING LAND

Remarks: C or R stands for Commercial or Residential
L or B stands for Land or Building
CI stands for corresponding owned land

LOGIC FLOW CHART FOR DEALING WITH HOTELS

LOGIC FLOW CHART FOR DEALING IN VARIOUS INVESTMENT

Remarks: T.O.M. stands for Take one more Financial Tool and F.T. stands for Financial Tools

LOGIC FLOW CHART FOR MORTGAGE TRANSACTIONS

LOGIC FLOW CHART FOR TRANSACTION PROJECTS

Remarks: I.M. stands for Investment Marks

GAME

BACKGROUND OF THE INVENTION

1. Field of the Invention

The invention relates to a game.

2. Description of Prior Art

Games are already known, such as MONOPOLY (trade mark), where players have markers that are moved around a board in turn and according to the throw of one or more dice, or similar. At each turn, the player's marker lands on one of various spaces or squares spread around a periphery of the board that indicate properties, utilities and chance cards. The player may be able to buy land, buy houses for the land, may be obliged to pay for services (water, gas, etc), may be obliged to pay rent or other penalties, or follow directions according to chance cards applicable to the space landed upon. Other games of a similar nature are known where the spaces are marked to provide investment opportunities and penalties relating to stocks and shares, metals (e.g. gold, or silver), purchase of basic commodities such as sugar, tea, coffee and so forth. In short, there are many games where experience and intrinsic value of financial transactions and planning can be gained while playing the game and where the accumulation of assets is the object of the game. Such games, hereinafter referred to generally as "games of the kind specified", lack an important practical ingredient, at least in terms of normal business practice, which can be broadly stated as "political influence". That is to say, in each advanced business culture there are "political" influences or factors in or affecting the market place which may be overt or covert and vary in scale and in perception from one culture to another. Nevertheless, games of the kind specified have so far not incorporated or taken into account such influences so as to alert or make game players aware of these influences (or even the possibility of these influences) affecting the course of and opportunities in doing business and carrying out financial business transactions.

SUMMARY OF THE INVENTION

It is an object of the invention to overcome this problem.

According to the invention there is provided a kit of parts for playing a game between a number of players comprising a first movable marker for each player, a board having a number of a first type of spaces spread in sequence around the periphery of the board onto which the markers are arranged to be moved, according to a throw of dice or similar chance device, to provide respective financial opportunities or penalties, including some spaces which contain instructions to the player to take a card from a first selected pack of cards offering other financial opportunities or penalties, such parts enabling players to play games of the kind specified, in which the board includes a number of a second type of spaces spread in sequence around the board inside of the first type of spaces, onto which respective a second movable marker for each player is arranged to be moved, according to a throw of a dice or similar chance device, the second type of spaces each comprising opportunities or penalties associated with political factors that impact on the player's financial transactions and decisions carried out in accordance with the first type of spaces.

The first set of spaces preferably include spaces relating to buying or selling land and buildings, and spaces relating to investments in types of industries.

The first set of spaces may include a space relating to a penalty for infringement of Patents or Copyright.

Preferably, there are approximately twice as many first type of spaces as there are second type of spaces.

A method of playing the game may comprise each player first throwing a die twice, or throwing two dice together, and selecting which of the first or the second of his markers to move according to each throw.

The method of playing a game may alternatively comprise first throwing a die, for moving one of the first and second respective markers, and then again throwing the die, for moving the other of the first and second respective markers.

DESCRIPTION OF THE PREFERRED EMBODIMENT

Figure 1:
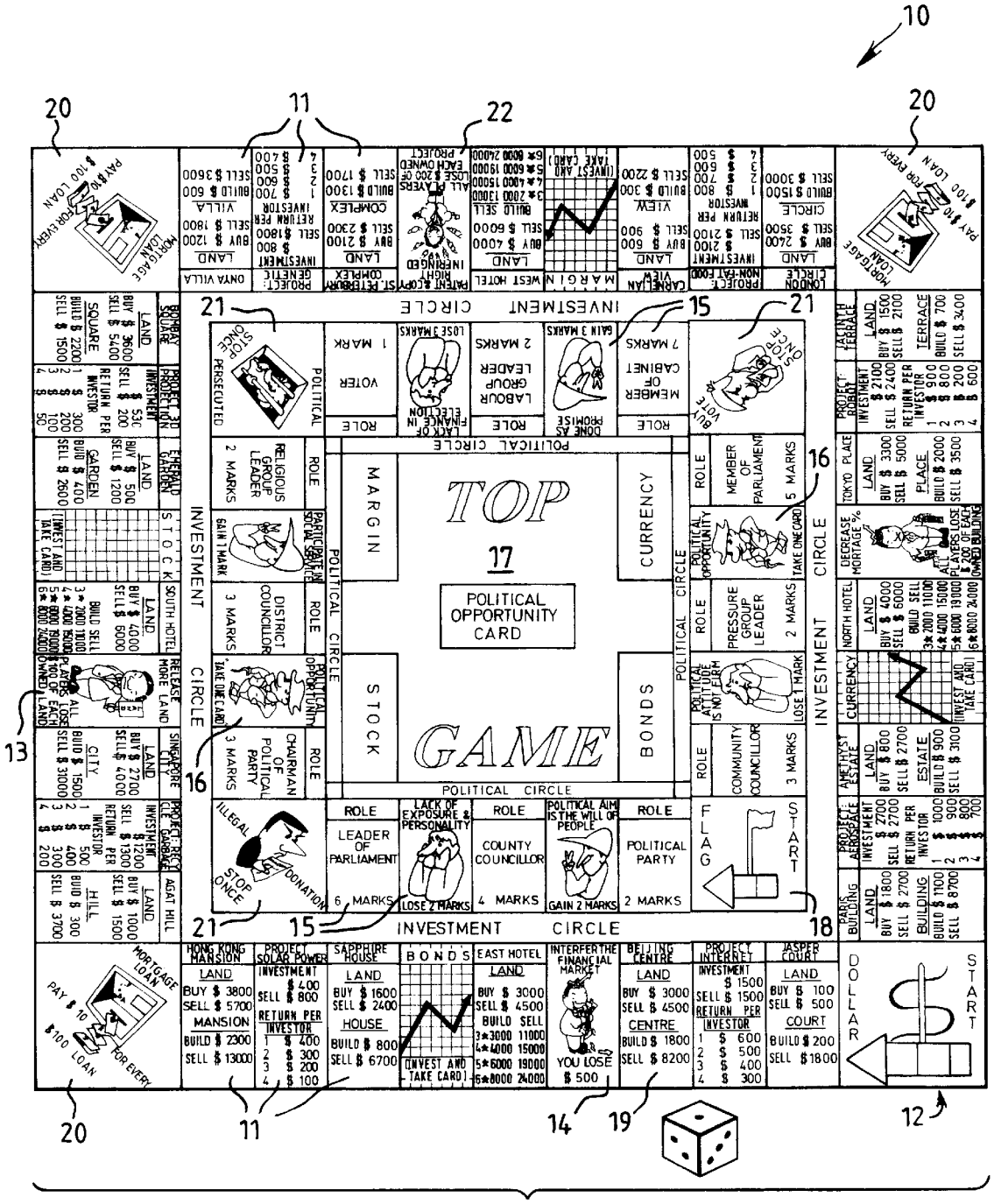
FIG. 1 illustrates the game board and die of the present invention.

The board (10) has a first type of spaces (11) extending in sequence around adjacent, outer peripheral edges of the board (10) from a START space (12) at the bottom right hand corner. There are ten spaces along each side of the board (10) and most of the first type of spaces (11) represent a financial opportunity or penalty. For example there are spaces that allow a player whose marker lands on the space to buy or sell land, and to build on the land according to marked prices. Some of the first type of spaces (11) confer a penalty on the player or all the players due to some overall change in the commercial market. For example, one space "RELEASE MORE LAND" (13) introduces a general penalty for players owning land because the space represents that more land has recently become available. This happens where the Government or Local Authority releases or converts some farm land say, to building land. This means that the overall value of building land currently privately owned will tend to reduce in market value as a result in an actual market. Another first type of space "INTERFERE IN FINANCIAL MARKET" (14) which could refer to a budget change that causes a loss, in practice, to a particular player's financial portfolio and so in the game the player looses HK$500. Other first type of spaces include activities relating to buying and selling BONDS, STOCK (i.e. Shares), MARGINS and CURRENCY according to corresponding "chance" cards taken from packs of cards relating to such investments.

In practice, each player (usually 2 to 4 players) has a suitable first respective marker that he moves in turn according to a throw of a dice around the board (10) from the START space (12). Players can conduct transactions or carry out instructions according to the space the markers land upon. In general therefore, the game comprise a "game of the kind specified" when making use of the first type of spaces (11), with the object of accumulating as many assets as possible to end up with a more valuable portfolio of assets than any of the other players at the end of the game.

The board (10) according to the present invention also includes however an inner set or second type set of spaces (15) extending in sequence around the board. There are six spaces along each side of the inner set square that make up the total second type of spaces. The second type of spaces (15) represent political factors, both opportunities and penalties, that in practice, that is to say in normal life experience, can influence the financial transactions carried out by the players as their first markers move around the first type of spaces (11).

Two of the second type of spaces (16) provide an instruction to take a "chance" political card from a pack of POLITICAL OPPORTUNITY CARDS placed on a central region (17) of the board.

The inner set of spaces or the second type of spaces (15) introduce into the overall game factors which in most cultures practically affect the security and welfare of the financial transactions. That is to say, in choosing to invest or choosing various types of investments, an investor, or a player in this case, is introduced to the idea that political factors should be considered. The political factors or influence may be covert or overt in practice, and even in a culture where so-called "political influence" is deemed to be a minimum, a change of a democratically elected government, a change of President or even a well-known predicted change of Government policy can have a significant impact on the value of land building and invested capital. It is also well-established in Western democratic cultures that so-called "lobbying" of parliamentarians, or other elected politicians, can lead to change in policy or laws that impact on property values and the financial market, in particular the stock exchanges. All these influences are perceived or herein referred to as "political factors".

Figure 2:
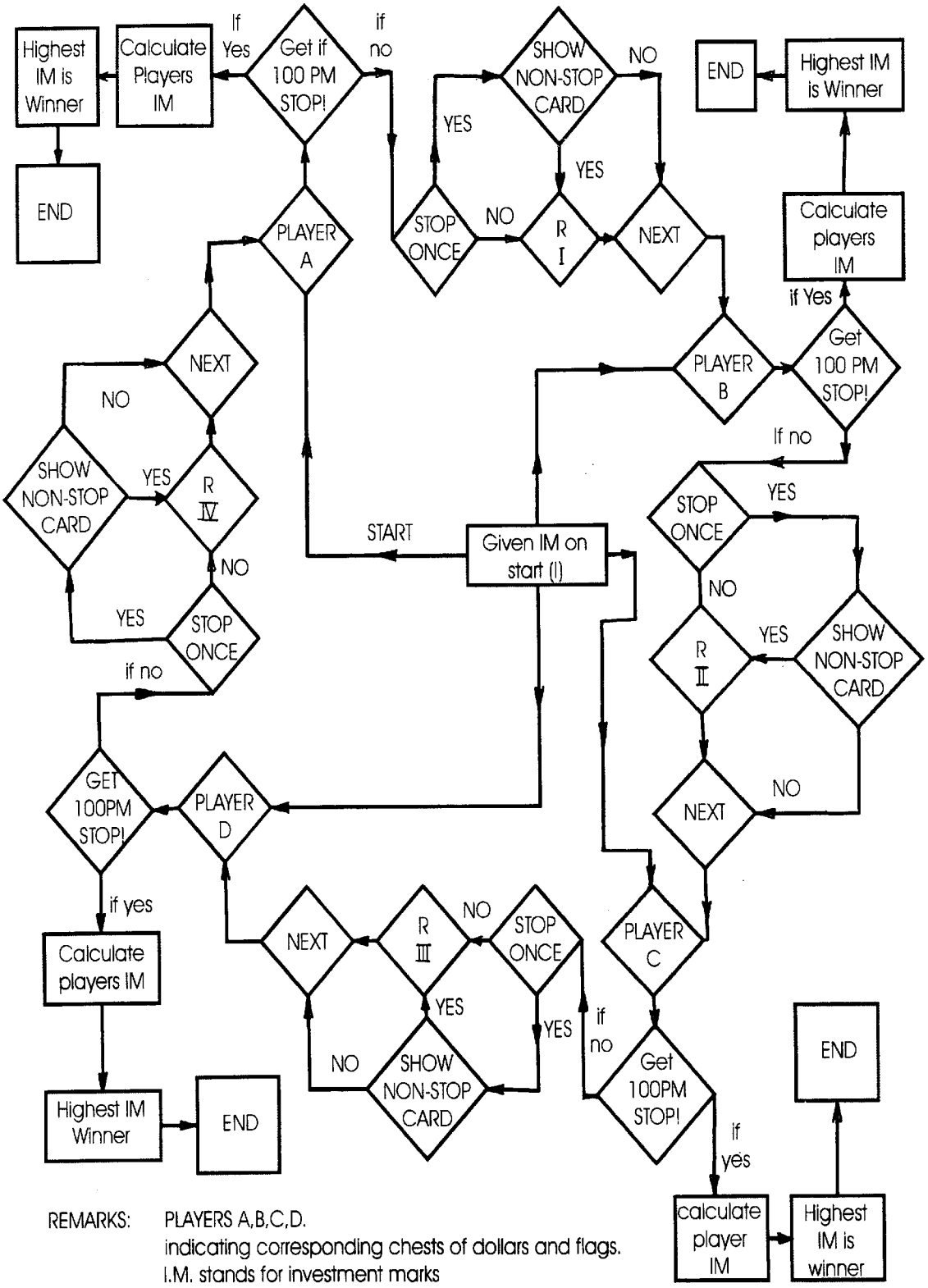
FIG. 2 shows a logic main flow chart of the overall game.

It is therefore proposed to modify the second type of spaces (15) where required to correspond to the kind of political factors of the culture in which the game is marketed. An important aspect of the games according to the invention is however preserved in this way, both to make the game more interesting for the players and to introduce or to maintain the idea that in normal practice investments decisions, "political" influences are invariable present, at least to some extent, and should be taken into account. In this way, for younger players perhaps, the political factors may be simply some extra abstract in varying the game, but for older players it provides an introduction or even a learning experience, that political factors invariably can have a positive or a negative influential role in relation to business decisions and influence which financial opportunities to take on or to give up. (Refer to FIG. 2)

Referring to the described game, there is a broad philosophy that relates primarily to first type of spaces (11). The basic philosophy of the described game is to make the best use of financial resources through wise choices and investment. Overall financial risk can be reduced by investing over a wide range of different types of investment. A player may however choose to risk at least some of his capital resources in much higher than average return investments. It will also be noted that some financial investments show a lower return as more players invest in the same activity. This introduces or reinforces the normal real life experience that the more people that compete for a limited sized investment or market, the lower the return will be in practice for each participant in a free market.

To play the game, each player starts with $10000 (ten thousand dollars) from a central Bank and in turn throws two conventional dice. Each player has two markers, a first and second, and places them respectively at the START (12,18) of the first and the second types of spaces. The player can decide, based on the thrown dice, which of his markers he moves corresponding to the two dice. Thus, if the player throws a TWO and a FOUR, he may move his markers two and four spaces respectively but can decide which of his markers to move the two spaces, and the other marker is then moved four spaces. The player can decide according to his perceptions and by anticipating and choosing which marker to move, which are the potential likely better opportunities or the potential least likely risks involved.

The players take turns and move their first markers around the board (10) in generally conventional manner.

Figure 3:
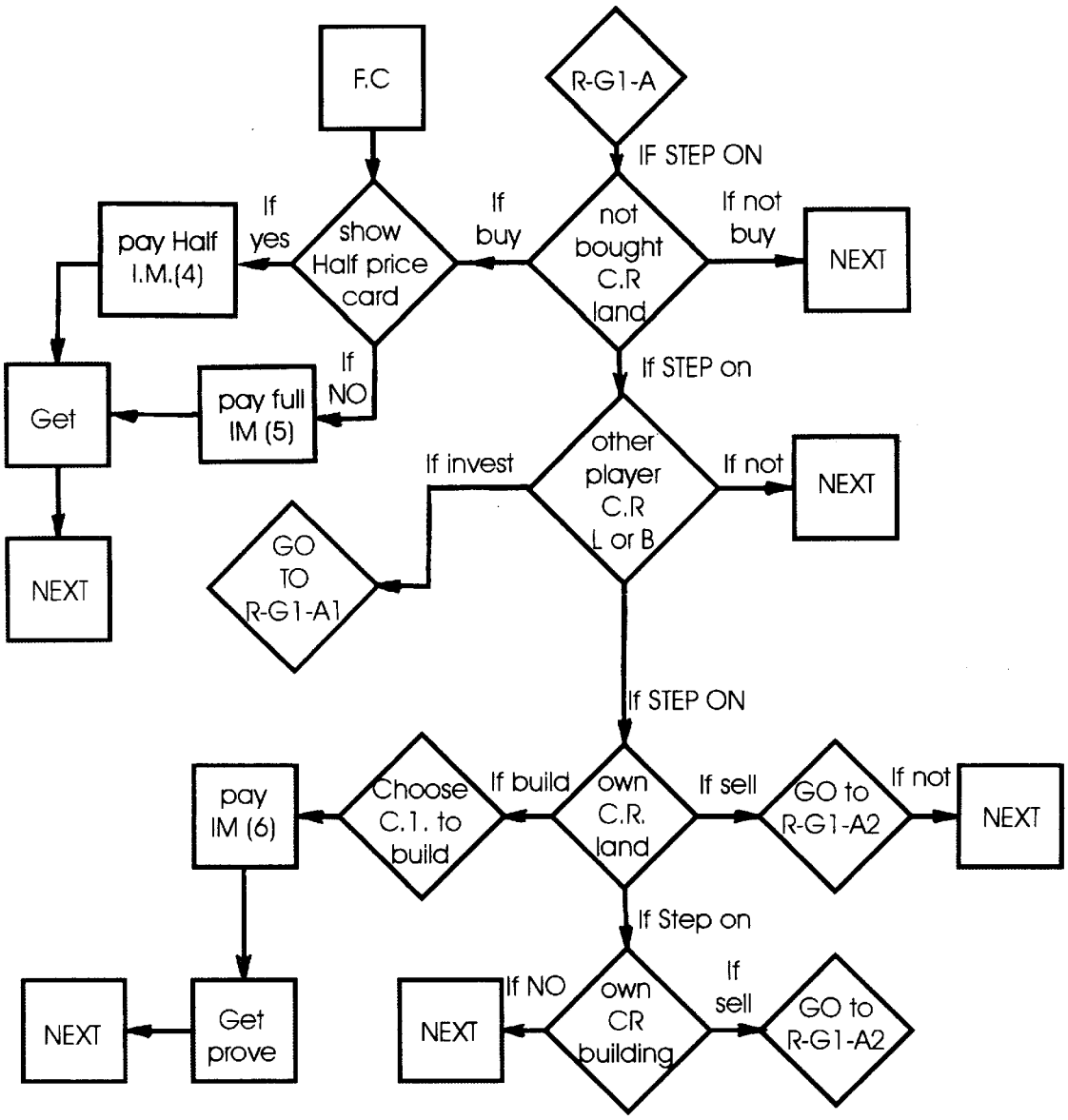
FIG. 3 shows a simple logic flow chart for buying land.
Figure 4:
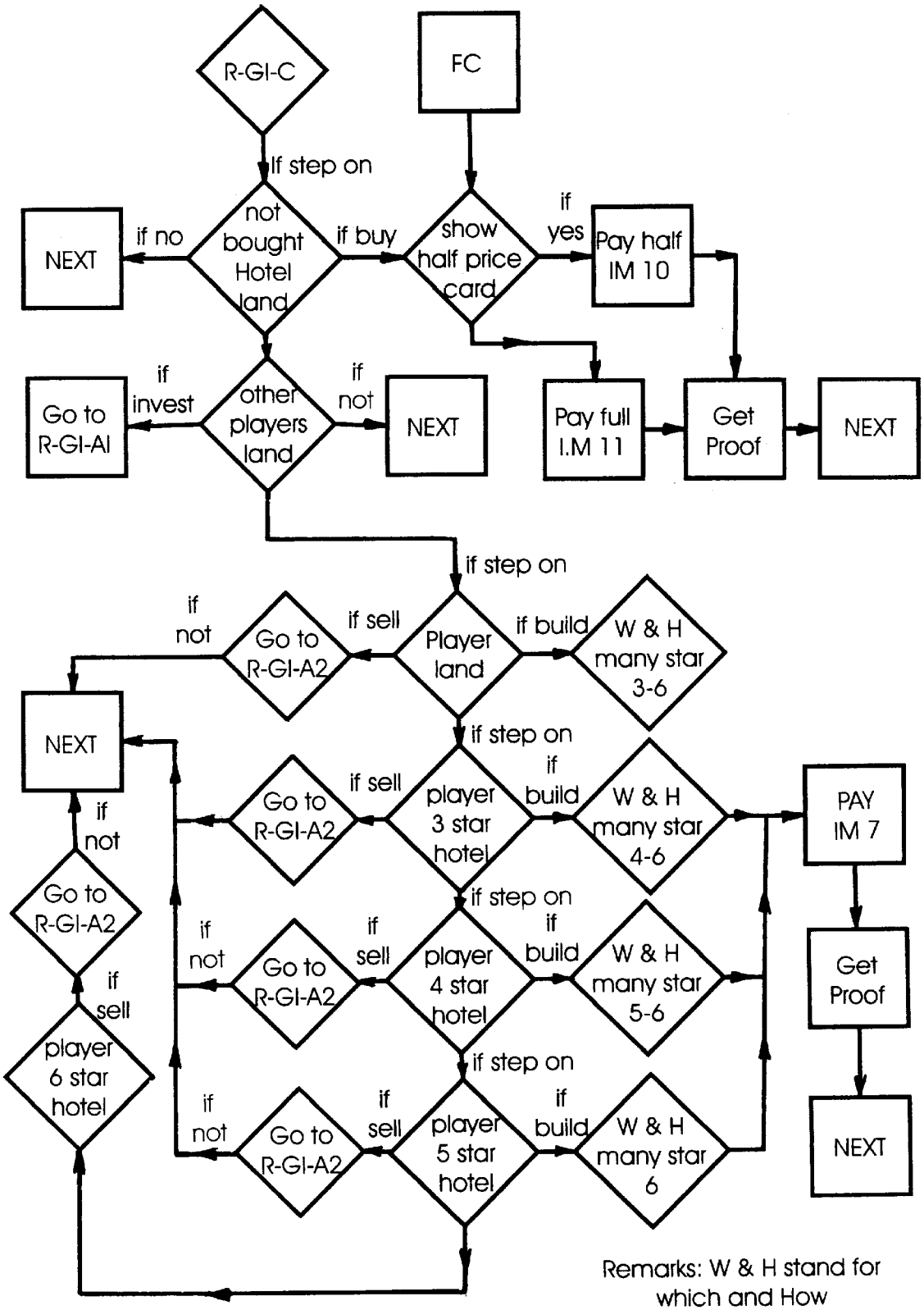
FIG. 4 shows a logic flow chart for dealing with hotels.
Figure 5:
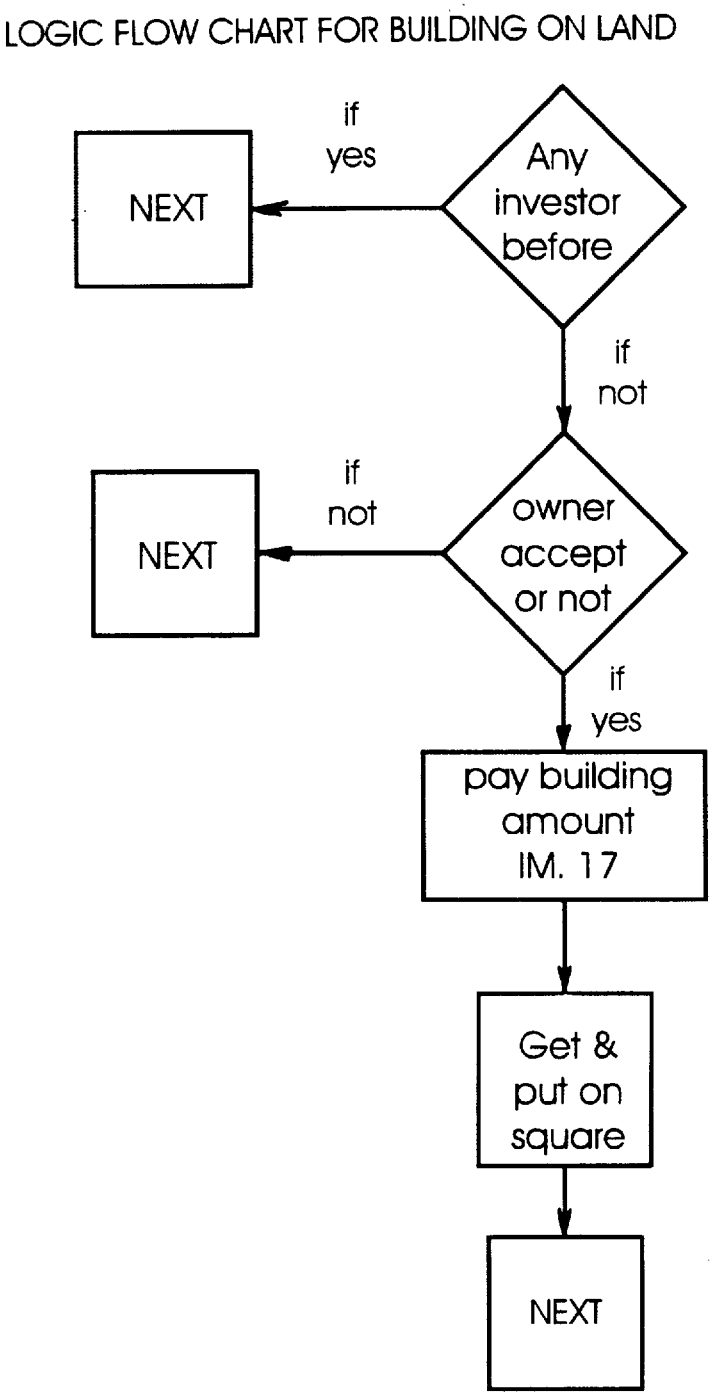
FIG. 5 shows a logic flow chart for building on land.

Every time the marker passes through the START (12) of the first type of spaces, the player collects $5000 (five thousand dollars) from the central Bank. At each space, the player has an opportunity to invest, to build, to sell or carry out a transaction or must take a card from a central region of the board, as appropriate. For example, if a player lands on the BEIJING CENTRE space (19), he may buy the land. If he does so, he places an identifying ownership piece or proof marker on the space. If any other player lands on BEIJING CENTRE (19) thereafter he may build on that land, but only with the owners cooperation. In that event, the other player pays the central Bank $1800 to build on the land. If a building is erected, should another player land there the building may be sold, so that the land owner and the building owner share the profit (i.e. receive $4100 each from the buyer). (Refer to FIGS. 3, 4 and 5)

Figure 6:
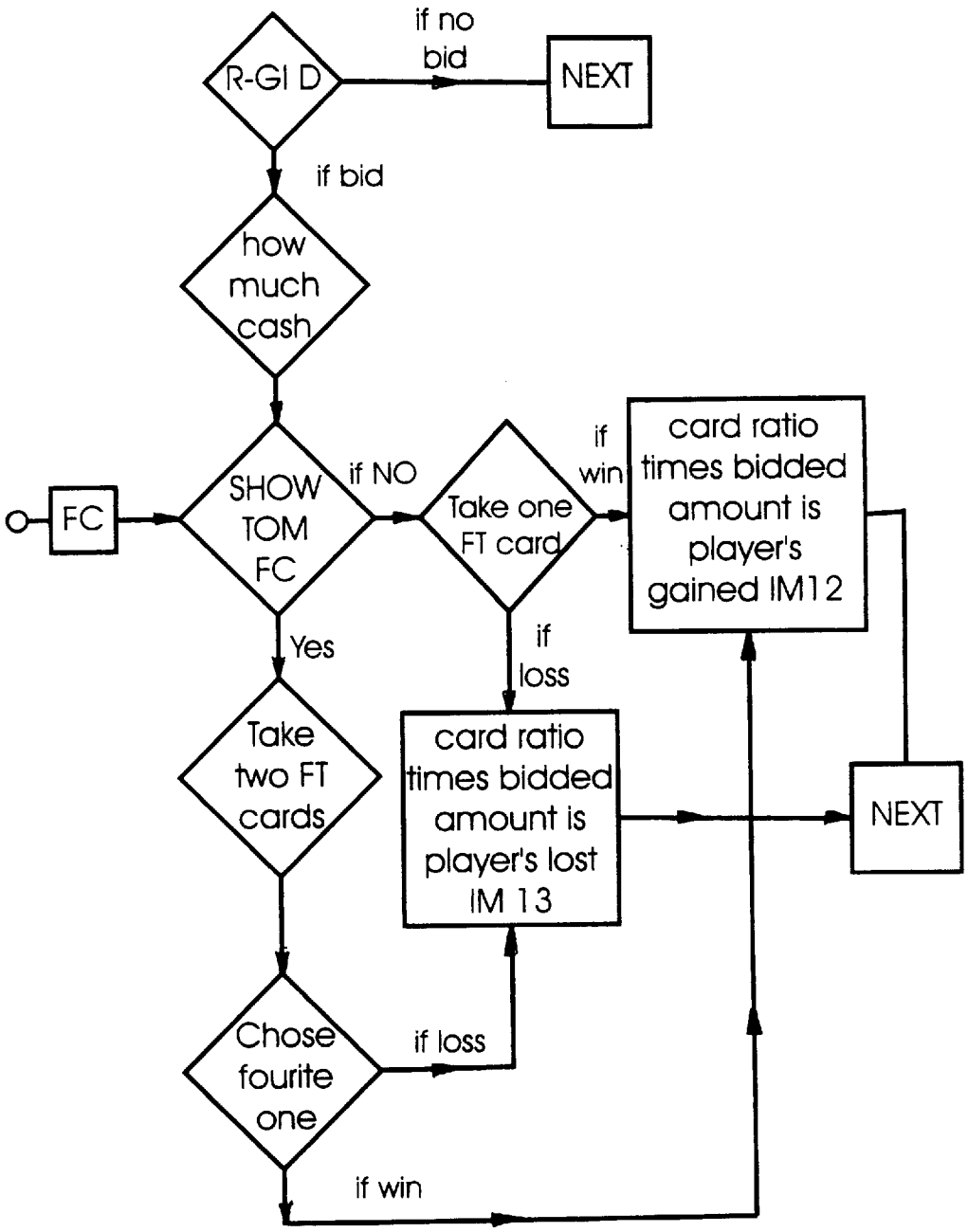
FIG. 6 shows a logic flow chart for dealing in various investments.

If a player lands on any of the movable property investment spaces, BONDS, STOCK, MARGINS or CURRENCY, he can decide to invest or not. A minimum investment is $1000 and if the player invests he takes an appropriate card from the central region of the board. The BOND, STOCK, MARGIN and CURRENCY cards each comprise eight previously shuffled cards placed face downwards on the central region of the board. A card is taken from the top of the appropriate pack as required, in a normal way. The cards comprise eight different percentages of gain and loss cards according to a realistic scale depending on the normal risks and returns of such types of investment. It is possible therefore for players to gain or loose a certain number of dollars for each $1000 invested. The player receives from or gives an amount to the central Bank according to the card picked up. In order to make the gains and losses normal or realistic the ranges appearing on the cards have maximum gains and losses for BONDS of 15%, for CURRENCY of 25%, for STOCKS of 40%, and for MARGINS of 60%. (Refer to FIG. 6)

Figure 7:
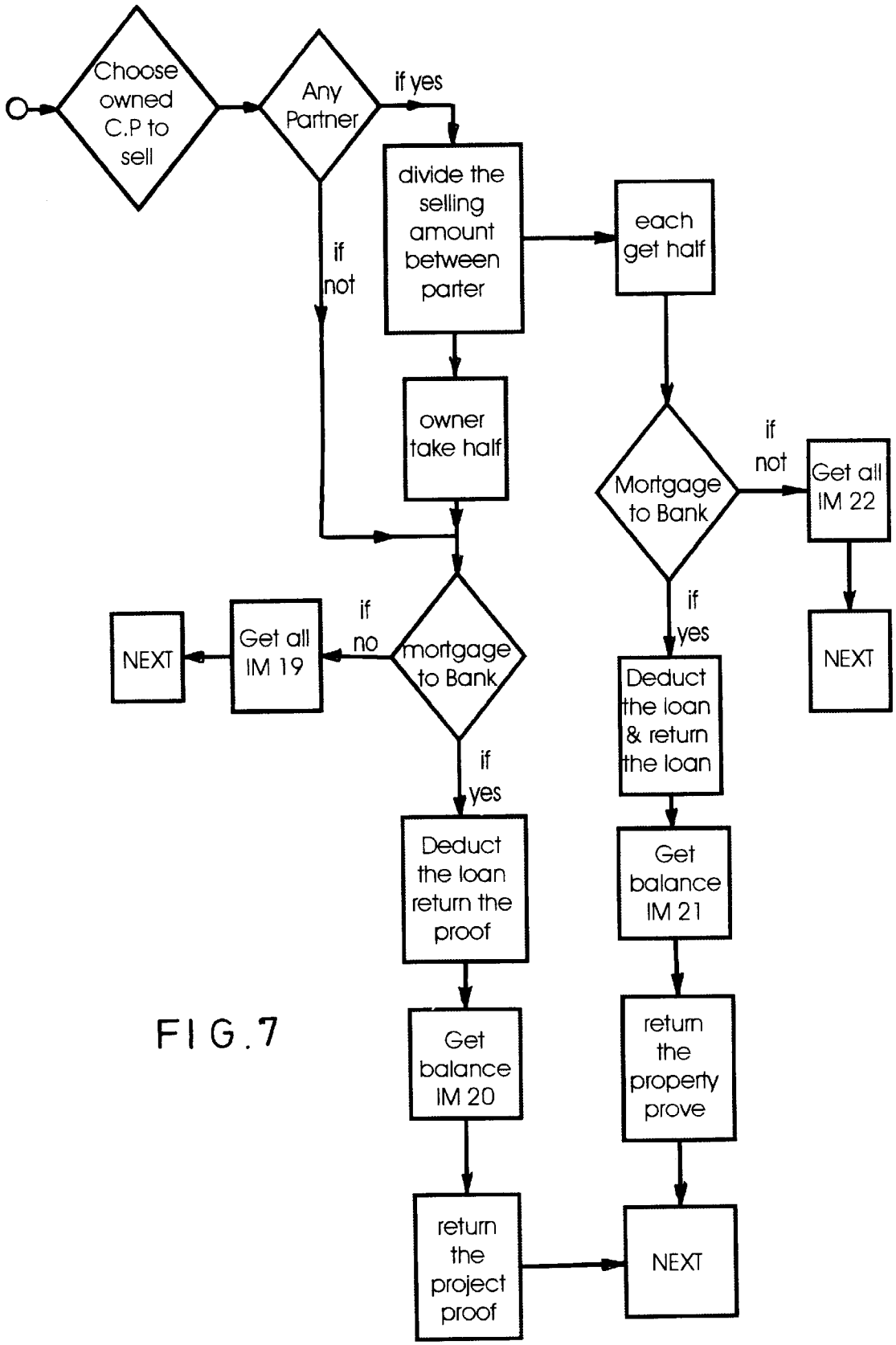
FIG. 7 shows a logic flow chart for mortgage transactions.

At three corners of the inner set there is a space (20) to give an opportunity to each player to take out a mortgage. It is necessary however for the player to be holding a property and therefore be able to pledge the property. The maximum loan is equal to half the bought price of the property and the interest indicated on the "mortgage" spaces must be paid to the central Bank. (Refer to FIG. 7)

Figure 8:
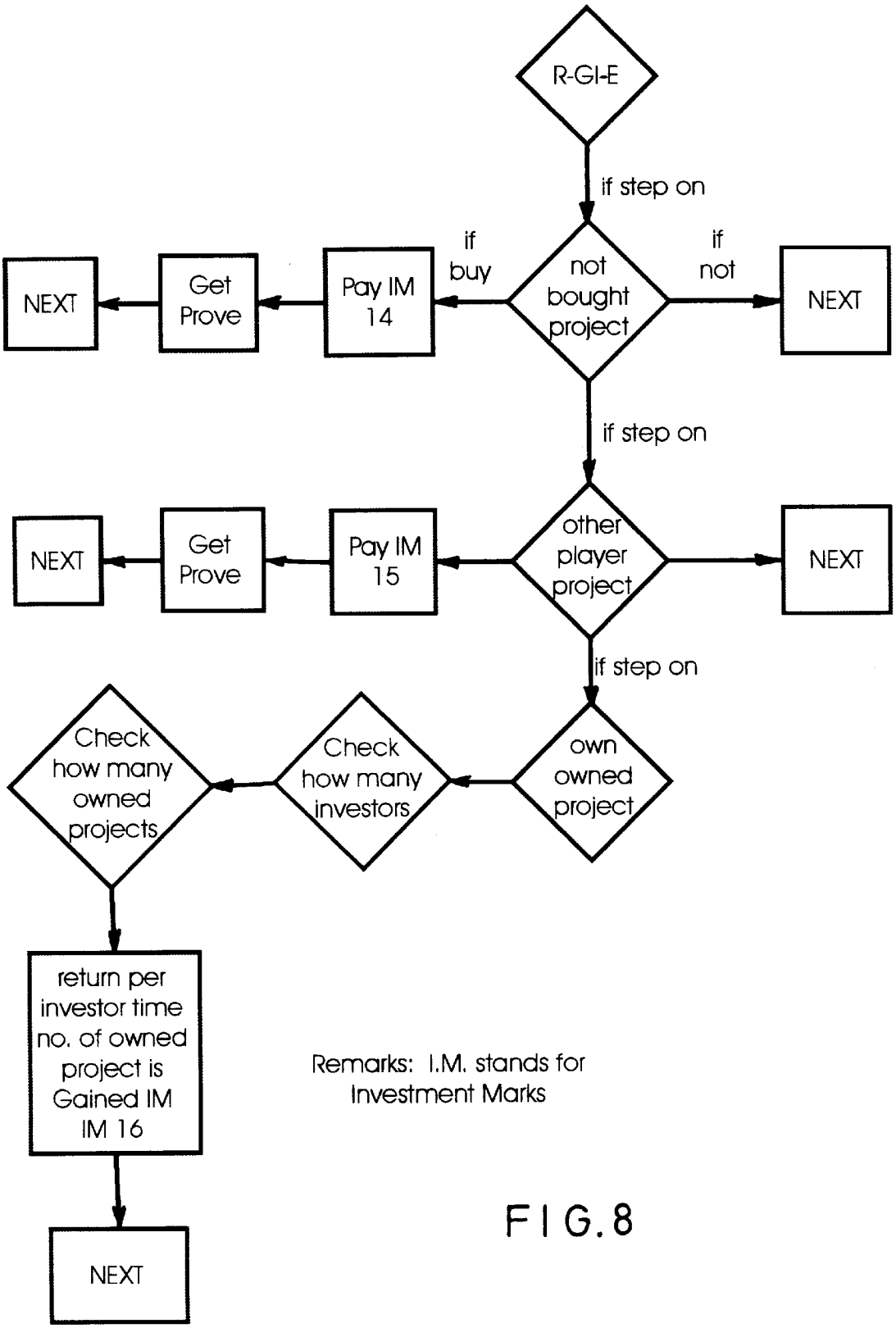
FIG. 8 shows a logic flow chart for transactions in projects.

There are eight spaces to provide opportunities to invest in manufacturing projects INTERNET, SOLAR POWER, etc. that each player may choose when he lands on one of these spaces. The player receives a dividend, according to how many of the other players have also invested in that project, every time he again lands on one of those spaces. The dividend is reduced as more players invest; this is in line with a practical reality that dividends normally reduce because the players have to share a generally finite sized market. The sale value therefore diminishes and the return will be smaller. (Refer to FIG. 8)

One way in practice to spread any risk is to invest in diverse projects and generally receive a good return overall. In the game, a player therefore receives a multiple of his normal return each time his square is visited. Thus, for example if the player has invested in two projects his return is doubled if either project space is visited, and so forth. Up to four times maximum multiple is possible.

The second type of spaces (15) provide opportunities or penalties to do with actual or implied political influence. As explained earlier, political influence can take many forms and tends to vary in practice from country to country. In the described game, the player's second markers move, according to the throw of one of the dice at each turn, around the second type of spaces (15). The player collects political marks and the overall game ends when any player has accumulated 100 political marks. At that time, the players add up the value of their financial assets, and the player with the largest total value wins the game.

The second type of spaces includes three penalty spaces (21), at three corners, where the player looses a next turn to move. These are also two spaces (16) where the player must take a POLITICAL OPPORTUNITY CARD from a pile of such cards on the central region (17) of the board. In this game there are twelve previously shuffled cards in the POLITICAL OPPORTUNITY pack placed face downwards on the board. The cards are as follows:

1. Political Influence: invest in or buy any manufacturing project
2. Political Influence: build on your land or any other player's land without requiring his permission
3. Political Influence: sell any one of your investments to the central Bank
4. Political Investigation: Half price card to buy any land at next opportunity at half price
5. Political Investigation: Half price card to buy any land at next opportunity at half price
6. Political Donation: Pay $1000 to central Bank
7. Political Donation: Pay $500 to central Bank
8. Political role allowance: receive $50 for every political mark you already have from the central Bank
9. Political power: deduct 10 political marks from every other player's total
10. Political power: Deduct 5 political marks from every other player's total
11. Political compromise: Non-stop card to submit if you land on a stop space, so you do not loose a turn
12. Political Donation: pay $300 to central Bank The land that is to be bought and sold is divided into three categories land for private housing, land for hotels and land for commercial use. The colour coding on the board is purple, yellow and brown respectively. During the game the types of land are normally treated together which will lead to joint ownership in some cases. However when a player visits any of the land spaces he may "do business", that is buy or sell property on any of the same type of land around the board. These transactions or "doing business" extend the scope of the game and also introduce specific experiences of negotiating with one or more of the other players. The practical coupling of the types of land is normal in real situations anyway as business normally confine their commercial activities to one type of land or one type of building developments.

The players may also move their two markers under the control of the throw of one dice by throwing the dice twice, instead of throwing two dice simultaneously. The dice may be replaced by other suitable random number generators, if preferred.

It will be appreciated that the described game on the one hand comprises a game generally of the kind specified, and which can take many forms. The game relates to purchasing and selling financial assets and investing in various projects. The player's first markers are moved around the outside of the board under the control of the throwing of a dice. One space in the first type of space relates to "PATENT AND COPYRIGHT INFRINGEMENT" (22) to introduce such an element or possible complication that often affects manufacturing projects in practice. Additionally and novelly, in games of the present invention the players are subjected to "political" influences arising out of their second markers landing on the set of second type of spaces (15).

It is impossible to specify with any accuracy to what extent "politics" plays any part in financial transactions and decisions in practice, and such part varies from country to country both in form and in magnitude anyway. It is however emphasised again that the political spaces, or the second type of spaces (15), not only add an interesting variation to an otherwise generally known type of game, but bring home to the players that "politics" are always present to some extent. In terms of learning therefore, the described game alerts the players to such influences or to the possibility of such influences being present in practical day-to-day transactions and business decisions relating to financial investments.

It will be noted that the inner spaces and activities provide a "timer" that determines in effect the speed of the game and its duration. In earlier financial type games, the speed and durations is much more artificially determined, or at least has much lesser relation to how the game is being conducted.

The board (10) may be replaced by a display on a Visual Display Unit screen, and the markers and other parts, may comprise symbols that are movable using a conventional mouse. Likewise, the "chance" cards may be stored in a computer programme and presented randomly on the screen as each player selects, as required, one of the cards from an appropriate one of the packs during the course of the game.

I claim:

1. A kit for playing a game between at least two players comprising: a first movable marker for each of said players, a board having a first type of spaces placed peripherally on said board onto which said first movable markers are positioned to be moved, said first movable markers moved according to a first die, said first type of spaces providing respective financial options, and instructions to said players to take a card from a first selected pack of cards offering other financial options, a second type of spaces placed peripherally within said first type of spaces on said board onto which a second movable marker for each of said players is positioned to be moved, said second movable markers moved according to a throw of a second die, said second type of spaces comprising options associated with political factors impacting said player's financial transactions and decisions carried out in accordance with said first type of spaces.

2. A kit of claim 1, wherein said first type of spaces further comprises first spaces relating to buying and selling land and buildings, and second spaces relating to investments in types of industries.

3. A kit of claim 1, wherein said first type of spaces further comprises a space relating to a penalty for infringement.

4. A kit of claim 1, wherein said first type of spaces further comprises a space relating to a penalty for copyright infringement.

5. A kit of claim 1, wherein said board further comprises more of said first type of spaces than said second type of spaces.

6. A method of playing a game comprising the steps of giving each of at least two players a preset dollar figure;

giving each of said players two movable markers, the first of said movable markers positioned for movement around a first type of spaces, said first type of spaces placed peripherally on a board, and said second movable marker positioned for movement around a second type of spaces, said second type of spaces placed peripherally within said first type of spaces;

rolling a first die and a second die;

moving said first movable marker and said second movable marker according to said first die and said second die respectively along the first and second types of spaces, in which the first type of spaces providing respective financial options, and said second type of spaces providing respective political factors to impact on each player's financial options.

* * * * *